US006223932B1

(12) United States Patent
Usui

(10) Patent No.: US 6,223,932 B1
(45) Date of Patent: May 1, 2001

(54) CRUSHABLE PLASTIC BOTTLE

(76) Inventor: Yoshio Usui, 14-15, Koenji-minami 1-chome, Suginami-ku (JP)

( * ) Notice: Subject to any disclaimer, the term of this patent is extended or adjusted under 35 U.S.C. 154(b) by 0 days.

(21) Appl. No.: 09/142,567

(22) PCT Filed: Dec. 18, 1997

(86) PCT No.: PCT/JP97/04682

§ 371 Date: Sep. 15, 1998

§ 102(e) Date: Sep. 15, 1998

(87) PCT Pub. No.: WO98/31592

PCT Pub. Date: Jul. 23, 1998

(30) Foreign Application Priority Data

Jan. 15, 1997 (JP) ..... 9-036857

(51) Int. Cl.[7] ..... B65D 1/32
(52) U.S. Cl. ..... 220/666; 215/382
(58) Field of Search ..... 215/381, 382, 215/380; 220/666, 667, 907; 138/121, 122, 118, 119; 426/111; 222/92, 107

(56) References Cited

U.S. PATENT DOCUMENTS

| | | | | |
|---|---|---|---|---|
| 972,095 | * | 10/1910 | Booth | 222/92 |
| 2,649,995 | * | 8/1953 | Muskin | 222/92 |
| 2,685,316 | * | 8/1954 | Krasno | 206/524.8 |
| 3,456,850 | * | 7/1969 | Uhlmann | 222/180 |
| 3,926,341 | * | 12/1975 | Lhoest | 215/900 X |
| 5,002,193 | * | 3/1991 | Touzani | 215/100 A |
| 5,054,631 | * | 10/1991 | Robbins, III | 215/900 X |
| 5,174,458 | * | 12/1992 | Segati | 215/383 |
| 5,255,808 | * | 10/1993 | Tobler | 215/900 X |
| 5,397,021 | * | 3/1995 | Usui | 220/667 |
| 5,584,413 | * | 12/1996 | Jung | 220/666 |
| 5,667,101 | * | 9/1997 | Barrash et al. | 222/92 |
| 5,711,445 | * | 1/1998 | Robbins, III | 220/8 |
| 5,746,339 | * | 5/1998 | Petre et al. | 215/383 |
| 5,979,326 | * | 9/1999 | Ohinata | 101/494 |

FOREIGN PATENT DOCUMENTS

| | | |
|---|---|---|
| 586133 | 3/1977 | (CH) . |
| 0611700 | 8/1994 | (EP) . |
| 2288445 | 5/1976 | (FR) . |
| 6812152 | 3/1970 | (NL) . |

* cited by examiner

*Primary Examiner*—Joseph M. Moy
(74) *Attorney, Agent, or Firm*—Laff, Whitesel & Saret, Ltd.; J. Warren Whitesel

(57) ABSTRACT

In a crushable plastic bottle, a plurality of foldable creases are formed on a wall surface of a body of the plastic bottle so as to in a longitudinal direction thereof in parallel. The foldable creases are formed so that wide and narrow creases are arranged alternately so as to form inequilateral lambda's (Λ's). When the foldable creases are folded, the narrow creased are roughly turned over in such a way that each inner surface of the narrow crease is brought into contact with the inner surface of each outward adjacent wide crease. Thus, with each narrow crease sandwiched between the two adjacent wide creases, the wide crease are overlapped with each other and fixed in shape as they are.

5 Claims, 4 Drawing Sheets

CRUSHABLE PLASTIC BOTTLE

BACKGROUND OF THE INVENTION

1. Field of the Invention

The present invention relates to a plastic bottle for containing liquid, and more specifically to a crushable plastic bottle which can be easily crushed to reduce the volume thereof, for convenience of collection whenever disused after the contained liquid has been used.

2. Description of the Prior Art

PET (polyethylene terephtalate resin) bottles, for instance are now widely used. Although these plastic bottles are usually disused after use, there exists a problem in that cost for disusing these plastic bottles is relatively high. In other words, since being not crushable easily after use, these plastic bottles are disused as they are in the original large volume and then carried to a plastic disposal plant in such an undesirable state that air is contained in these plastic bottles. This requires a relatively large cost for transportation although it is preferable to reduce the cost for disposal of these plastic bottles.

SUMMARY OF THE INVENTION

With these problems in mind, therefore, it is the object of the present invention to provide a crushable plastic bottles whose volume can be easily reduced after use.

In order to achieve the above object, in accordance with the present invention, there is provided a crushable plastic bottle formed with a spout portion, wherein a plurality of foldable creases are formed on a wall surface of a body of the plastic bottle so as to in a longitudinal direction thereof in parallel, the foldable creases being formed so that wide and narrow creases are arranged alternately so as to form inequilateral lambda's (Λ's), and the plastic bottle having an non-circular section in a direction perpendicular to a crushing direction. In this configuration, when the foldable creases are folded, the narrow creased are roughly turned over in such a way that each inner surface of the narrow crease is brought into contact with the inner surface of each outward adjacent wide crease. Thus, with each narrow crease sandwiched between the two adjacent wide creases, the wide crease are overlapped with each other and fixed in shape as they are. This facilitates to minimize the final shape of the plastic bottle when crushed so that the plastic bottle can be crushed into a very compact shape.

Preferably, when seen from above, the plastic bottle is oval in shape, and when seen from front, the heights of both shoulder portions of the plastic bottle are reduced gradually toward both sides thereof, and both outside surfaces of a bottom portion of the plastic bottle are chamfered. This further facilitates to minimize the final shape of the plastic bottle when crushed so that the plastic bottle can be crushed into a very compact shape.

Preferably, the body has also a spout portion.

Preferably, in each of the creases, a cutoff or groove portion is formed extending along each ridge line thereof. This facilitates folding of the creases when the plastic bottle is crushed.

DETAILED DESCRIPTION OF THE PREFERRED EMBODIMENTS

The crushable plastic bottle according to the present invention will be described hereinbelow with reference to the attached drawings.

FIGS. 1(*a*) and 1(*b*) show an embodiment thereof, in which an external shape of a plastic bottle is shown. In FIG. 1A, the horizontal direction is referred to as a width direction of the plastic bottle and the vertical direction thereof is referred to as a thickness direction of the plastic bottle. Further, in FIG. 1B, the vertical direction is referred to as a vertical or a longitudinal direction of the plastic bottle. Further, in FIG. 1B, the surface shown is referred to as a front surface of the plastic bottle, and the surfaces on both sides are referred to as side surfaces of the plastic bottle.

Figure 1A:
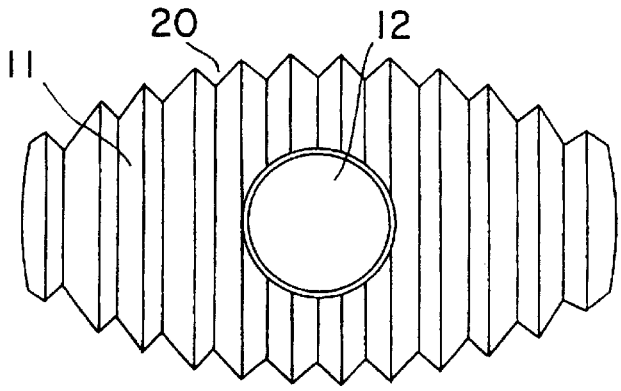
FIG. 1A is a top view showing an embodiment of the crushable plastic bottle according to the present invention.
Figure 1B:
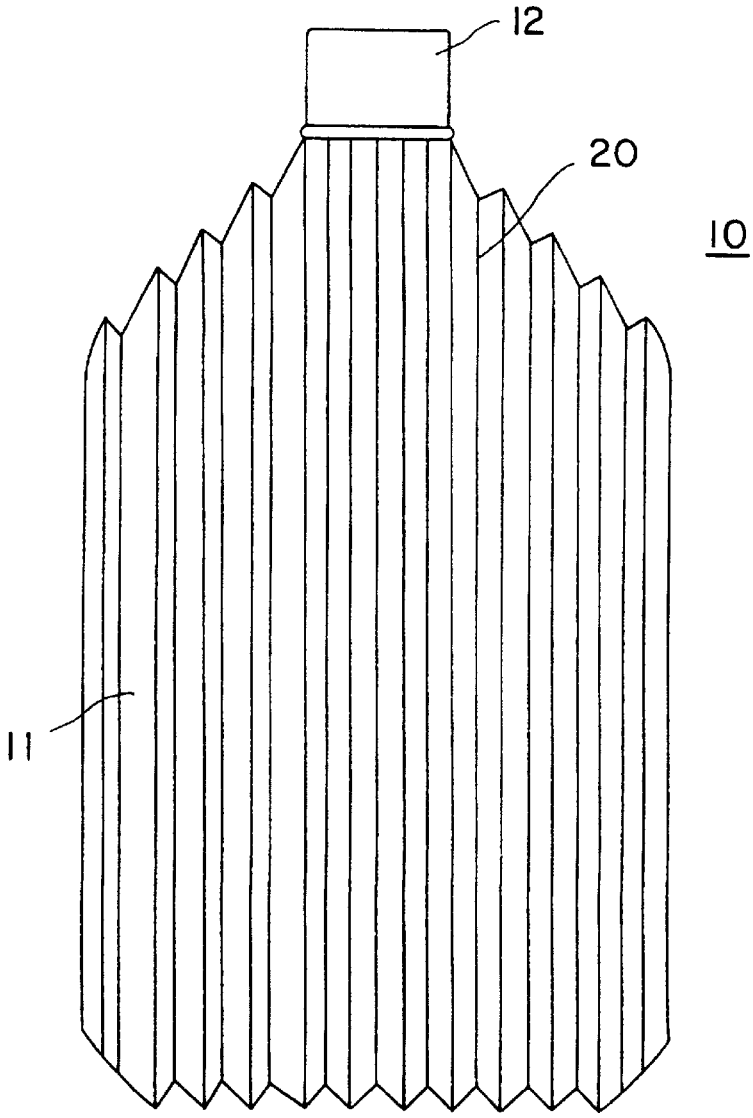
FIG. 1B is a side view showing an embodiment of the crushable plastic bottle according to the present invention

As shown in FIG. 1A, the plastic bottle denoted by generally, 10, is oval in shape when seen from above. The plastic bottle is formed with a spout portion 12 at the central portion thereof and with a plurality of foldable creases 20 on both the front and rear side surfaces and the upper surface thereof. These foldable creases 20 are formed in such a way that the plastic bottle can be crushed easily when a force is applied in the major axis (width) direction of the plastic bottle when seen from above in FIG. 1A. To facilitate the folding of the plastic bottle, these foldable creases are formed in parallel to each other on the wall surface of the plastic bottle at roughly regular intervals in such a way as to extend in the plastic bottle vertical direction and to surround the plastic bottle when the plastic bottle is stood as shown in FIG. 1B. In other words, the foldable creases 20 are formed all over the surfaces of the plastic bottle 10, except the spout portion 12 and the top and bottom portions and both side surfaces thereof.

Each of these foldable creases 20 is formed in such a shape that the cross-sectional shape thereof is of inequilateral a lambda shape. In addition, the plastic bottle 19 has a non-circular section in a direction perpendicular to a crushing direction. therefore, the two opposing oblique surfaces for forming the creases 20 are not equal to each other. Further, in each of these creases 20, a cutoff or groove portion is formed extending along each ridgeline thereof to facilitate folding of these creases 20 when the plastic bottle 10 is crushed.

Further, when the overall shape of the plastic bottle 10 is seen from the front surface side thereof as shown in FIG. 1B, the heights of both the shoulder portions of the plastic bottle are reduced gradually toward both the sides of the plastic bottle. In addition, both the outside surfaces of the bottom portion of the plastic bottle are chamfered as shown in FIG. 1B.

Owing to the above-mentioned shape, when the creases 20 are folded, since the outside creases can be folded into the inside creases, respectively, it is possible to minimize the shape of the crushed plastic bottle when these creases 20 are folded.

Figure 2:
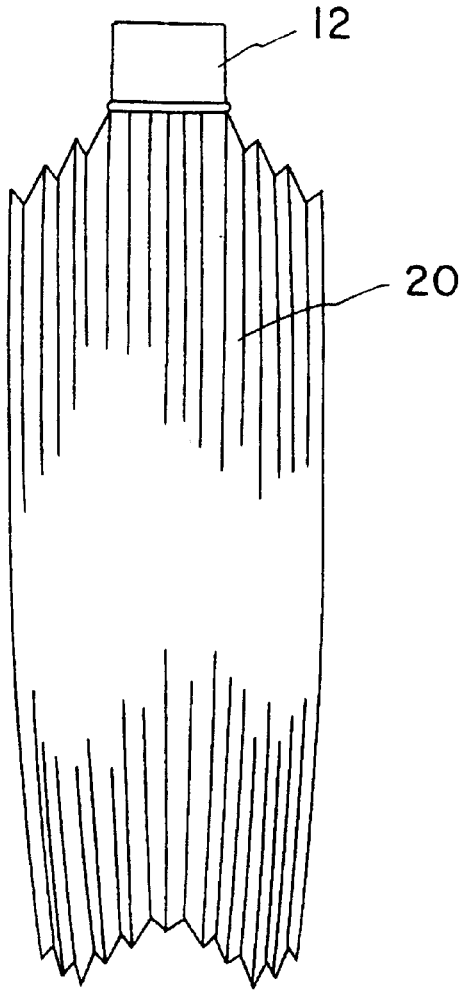
FIG. 2 is a side view showing the crushed plastic bottle shown in FIGS. 1A and 1B.

FIG. 2 is a side view showing the shape of the crushed plastic bottle 10. Here, it should be noted that when crushed, the plastic bottle shape is not only reduced in the width direction thereof, but also both horizontal ends of the plastic bottle 10 dangle downwards at the bottom thereof, as compared with the middle portion thereof. This is because the plastic bottle shape is formed in such a way that the heights of both the shoulder portions of the plastic bottle are reduced gradually toward the outside surfaces of the plastic bottle. In addition, the creases 20 formed on the upper surface of the plastic bottle 10 so as to extend in the thickness direction are reduced gradually toward both the sides of the plastic bottle, as shown in FIG. 1(*a*). Therefore, when the creases 20 are folded, since the outside creases can be folded into the inside creases, it is possible to minimize the shape of the plastic bottle.

Figure 3:
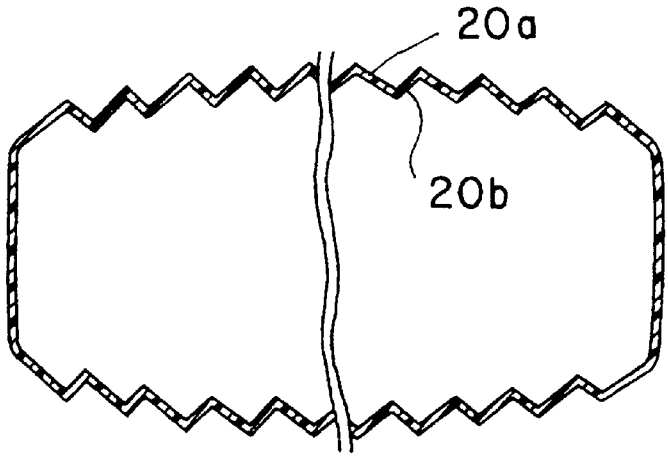
FIG. 3 is a bottom view of a plastic bottle having foldable creases which are useful to minimize the final shape of the plastic bottle when crushed.

FIG. 3 is a cross-sectional view showing an optimum crease structure for minimizing the final shape of the plastic bottle. As shown, in FIGS. 1 and 3 a wide crease 20*a* and a narrow crease 20*b* (in the plastic bottle width direction) are arranged alternately in combination. Therefore, when folded, the narrow creases are roughly turned over (e.g., inside out) in such a way that each inner surface of the narrow crease is brought into contact with the inner surface of each outward adjacent wide crease; that is, with each narrow crease sandwiched between the two adjacent wide creases, the wide creases are overlapped with each other and fixed in shape as they are. As a result, it is possible to crush the plastic bottle into a compact possible shape. The oval shape of the plastic bottle when seen from above as shown in FIG. 1A and the triangular shape of the shoulder portion of the plastic bottle when seen from the front side as shown in FIG. 1B as described above are decided in order to achieve the above-mentioned object.

Figure 4:
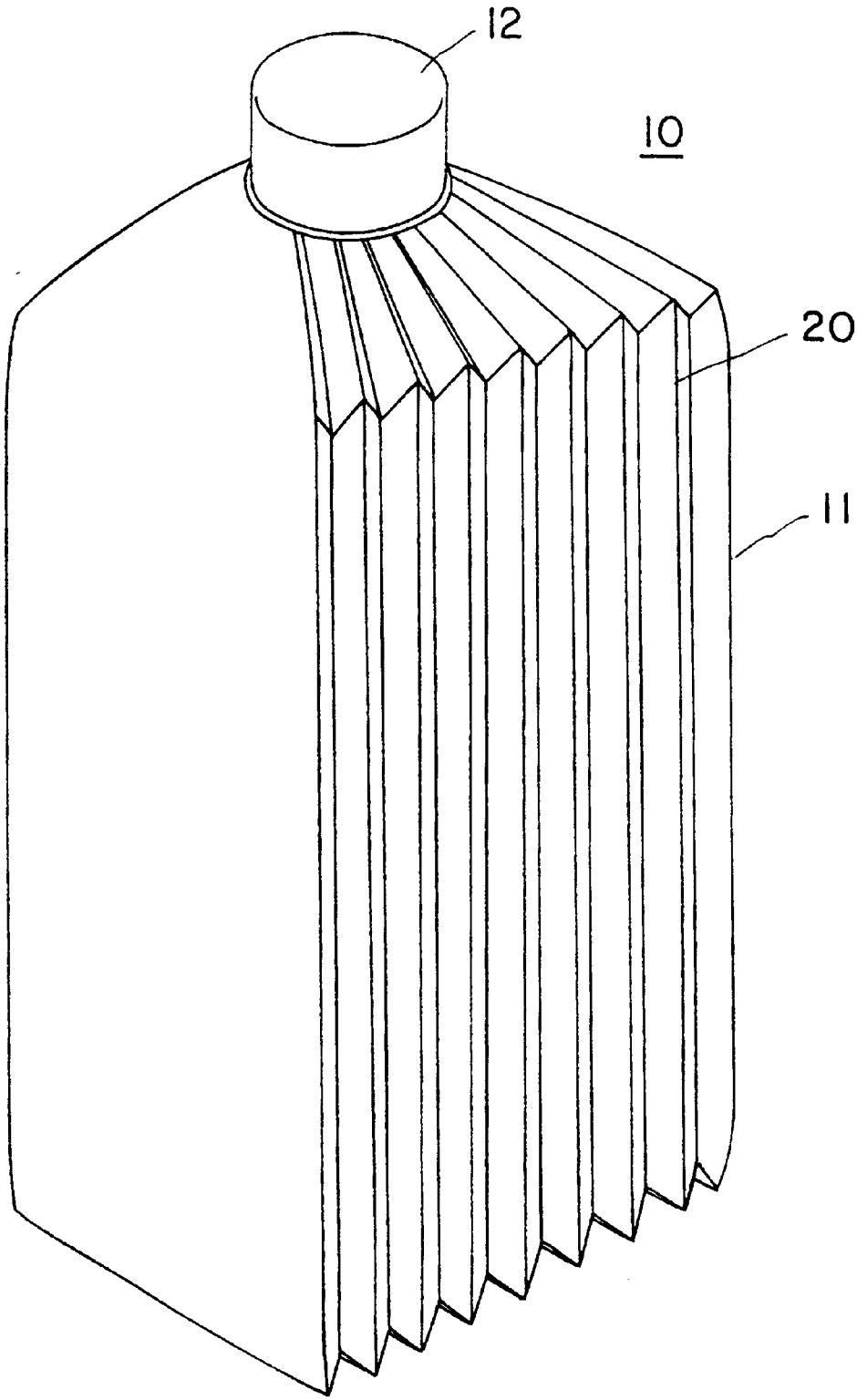
FIG. 4 is a perspective view showing another embodiment of the crushable plastic bottle according to the present invention.

FIG. 4 is a perspective view showing another embodiment of the crushable plastic bottle according to the present invention. In this embodiment, the foldable creases formed on the upper surface of the plastic bottle body 11 are formed in such a way that the width of the foldable creases 20 are reduced toward the spout portion 12; that is, the foldable creases 20 extend from the middle spout portion 12 in the radial direction on the upper shoulder portion of the plastic bottle body 11. Therefore, in this embodiment, it is possible to increase the rigidity of the plastic bottle as compared with that shown in FIGS. 1A and 1(*b*), so that this plastic bottle is easy to grip and handle for use.

In this embodiment, however, since the creases formed on both the side surfaces of the plastic bottle body 11 are not folded perfectly, the final shape of the crushed plastic bottle obtained when seen as shown in FIG. 2 is slightly rounded in such a way that both sides of the bottle downward like the shape shown in FIG. 2 and the middle portion thereof swells.

Figure 5:
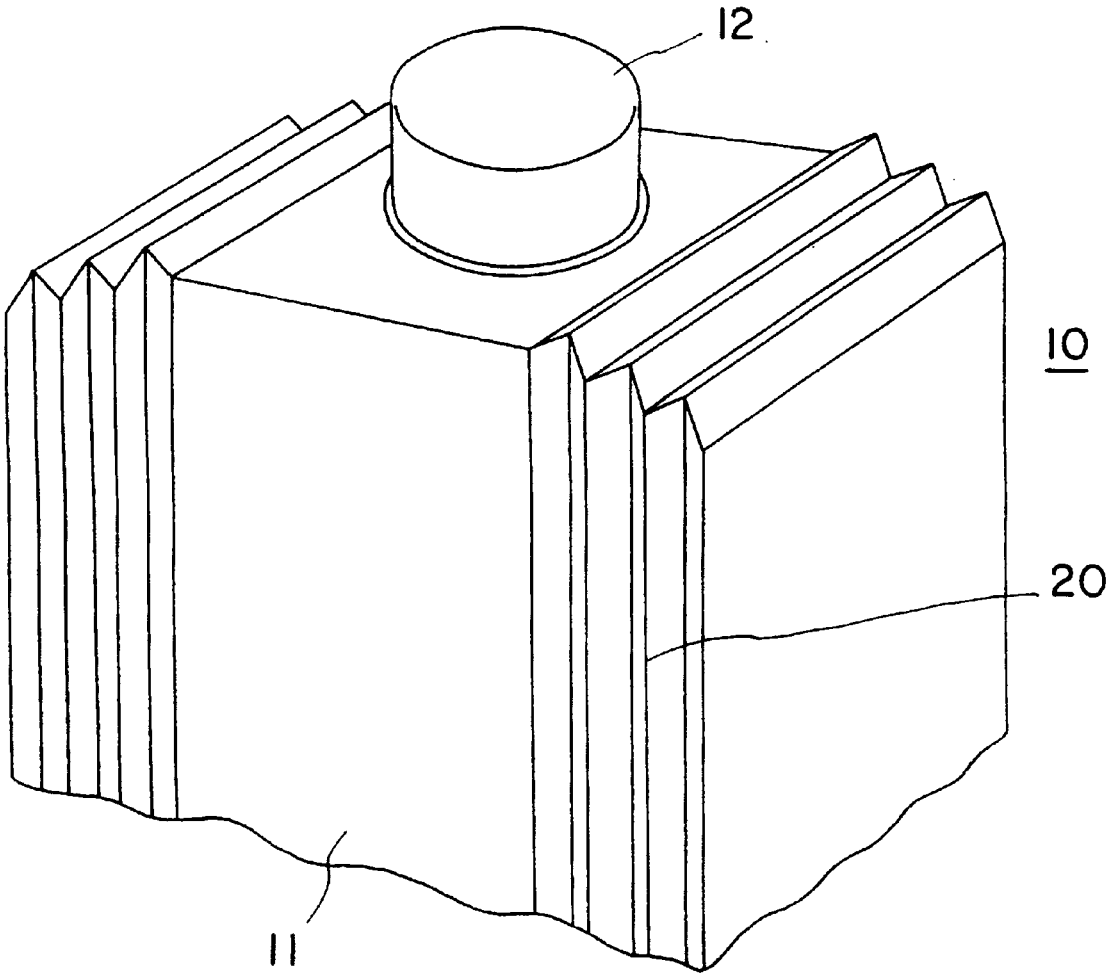
FIG. 5 is a perspective view showing still another embodiment of the crushable plastic bottle according to the present invention.
Figure 1A:
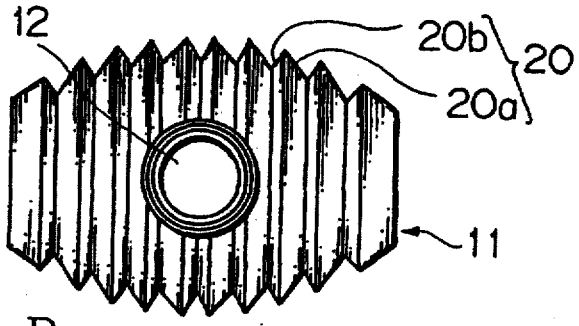
Figure 1B:
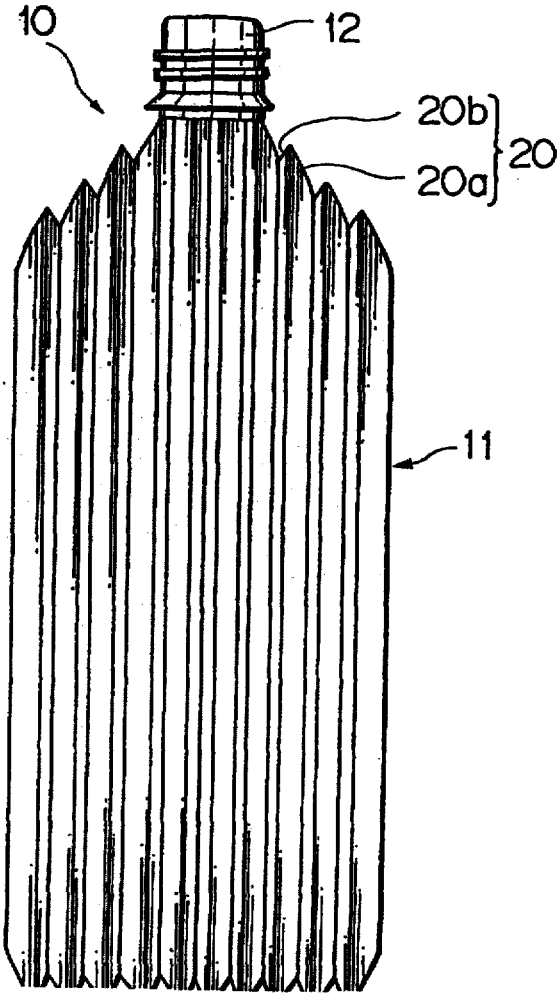
Figure 2:
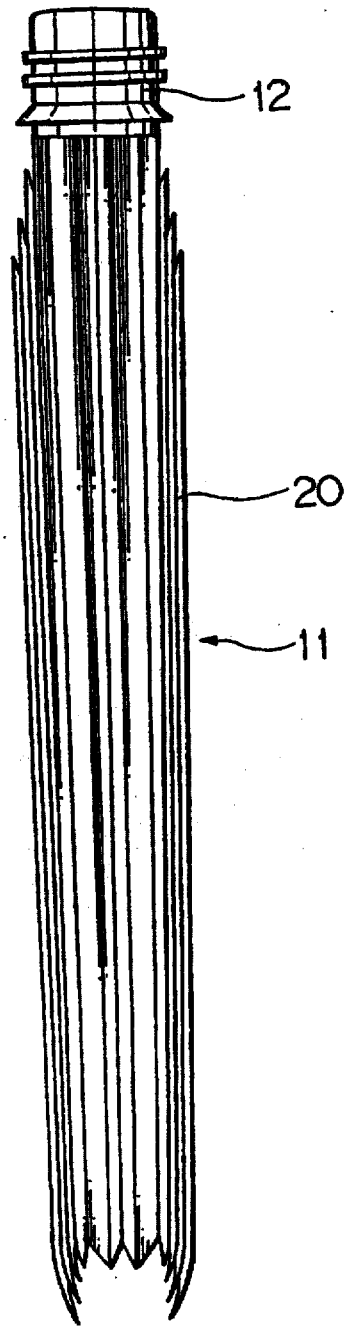
Figure 3:
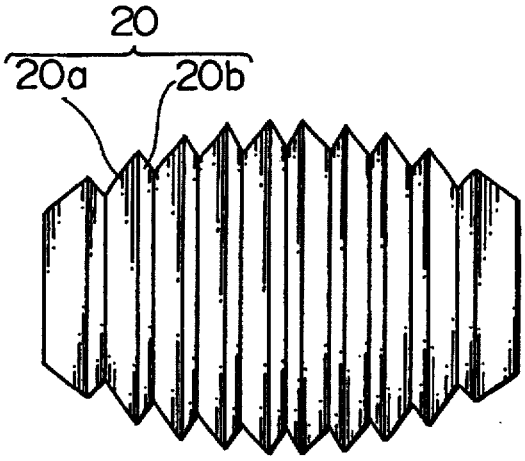
Figure 5:
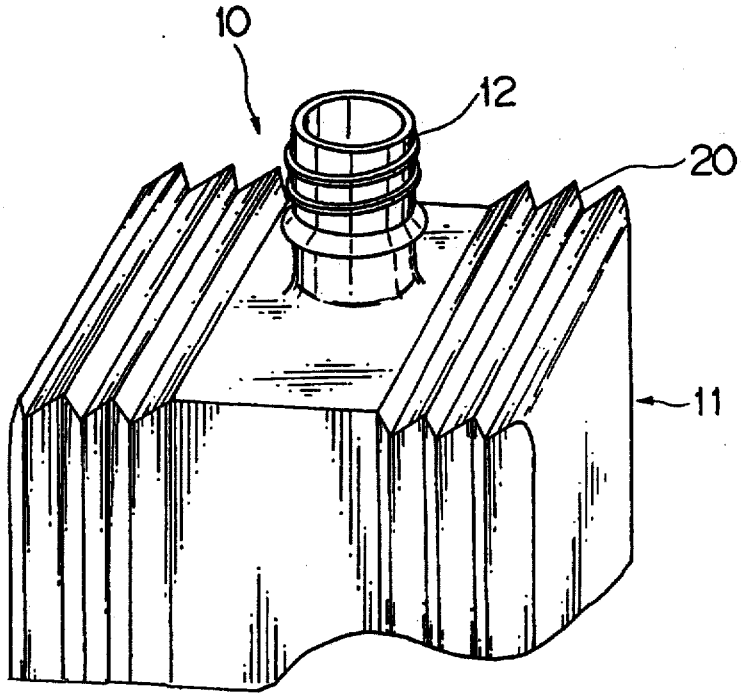
Figure 4:
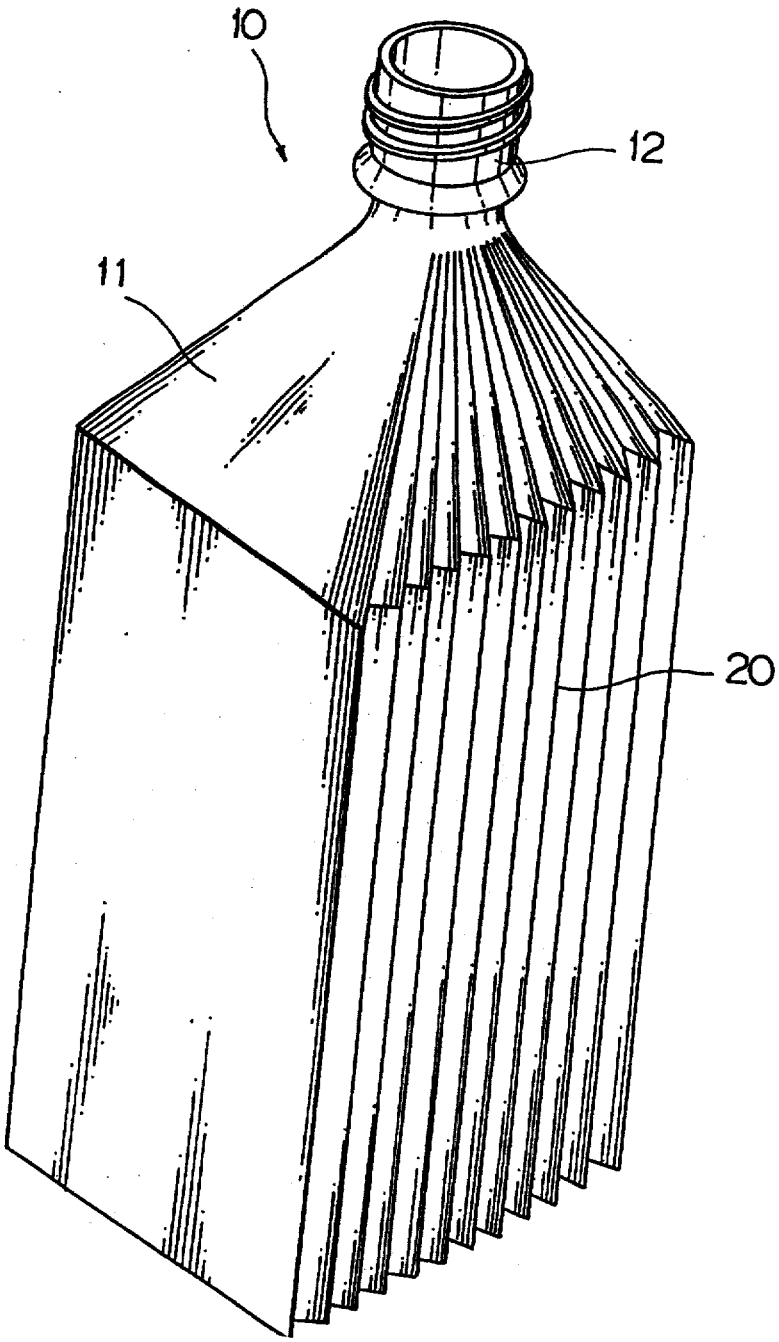

FIG. 5 is a perspective view showing still another embodiment thereof. In this embodiment, the foldable creases are formed only on both side surfaces of the plastic bottle, without forming the creases on the middle portion of the front surface of the plastic bottle body 11. In this embodiment, since no creases are formed at the middle portion of the plastic bottle body, although not effective from the standpoint that the plastic bottle shape must be minimized when crushed, since the plastic bottle can be gripped by the user's hand easily from above or from below, this plastic bottle body is easy to hold and handle.

Further, in the above-mentioned embodiments, the plastic bottle shape is of oval shape when seen from above and of roughly rectangular shape when seen from front. However, as far as the foldable creases can be formed on the surface of the plastic bottle body, the gist of the present invention can be applied to the plastic bottle of any shape. For instance, the present invention can be applied to the plastic bottle whose cross-section is of circular or rectangular shape other than the oval shape.

Further, in the above-mentioned embodiments, although the plastic bottle formed with a spout portion is described, the present invention can be applied to the plastic bottle formed with no spout portion.

What is claimed is:

1. A plastic bottle which can be crushed and collapsed both before and after use, said bottle having a plurality of creases that form parallel pleats on wall surfaces of a body of said plastic bottle, said pleats extending around a perimeter of said body including top, bottom and two opposite disposed side surfaces of said bottle, said pleats having a wide panel and a narrow panel with said creases alternately forming ridges and roots of said pleats, the relative dimensions of said wide and narrow panels enabling creases near an outside surface of said bottle to fold into creases near a center of said bottle, whereby said bottle can be shipped in a collapsed condition prior to use, expanded for use, and again collapsed after use.

2. The bottle of claim 1 where a height of shoulder portions of said bottle slope downwardly from a neck of said bottle toward sides of said bottle whereby the outside size of said bottle is reduced in height at the upper surface thereof.

3. The bottle of claim 2 wherein an outside perimeter surface surrounding a bottom of said bottle is chamfered.

4. The bottle of claim 1 wherein a front to back thickness of said bottle is gradually reduced so that the bottle becomes progressively thinner from a relatively thicker portion adjacent a neck of said bottle to a thinner portion at the opposite sides of said bottle.

5. An elongated crushable plastic bottle having a top side, a bottom side, and two elongated vertical sides extending between said top and bottom sides, said top side having an opening therein, said bottom side being a closed surface, whereby said bottle may be filled and emptied via said opening, a plurality of spaced parallel creases extending vertically along the elongated length of the vertical sides and continuing across the top and bottom surfaces of said bottle, said creases alternately forming ridges and valleys which define side wall panels of said pleats, the relative dimensions of said side wall panels of said pleats forming alternately wide and narrow panels, said wide panels being on a side of said pleat which is nearer a center of said bottle and said narrow panel being on a side of said pleat which is nearer the outside of said bottle, and the relative dimensions of said wide and narrow panels enabling said wide panels near an outside surface of said bottle to fold onto said narrow panels nearer the center of said bottle.

* * * * *

UNITED STATES PATENT AND TRADEMARK OFFICE

CERTIFICATE OF CORRECTION

PATENT NO. : 6,223,932 B1
DATED : May 1, 2001
INVENTOR(S) : Usui

It is certified that error appears in the above-identified patent and that said Letters Patent is hereby corrected as shown below:

The title page, showing the illustrative figure, should be deleted to appear as per attached title page.

Drawing Sheets 1-4 should be deleted to replace Drawing Sheets 1-4, consisting of Figs. 1-5, as shown on the attached pages.

Signed and Sealed this

Twenty-ninth Day of January, 2002

*Attest:*

*Attesting Officer*

JAMES E. ROGAN
*Director of the United States Patent and Trademark Office*

(12) United States Patent
Usui

(10) Patent No.: US 6,223,932 B1
(45) Date of Patent: May 1, 2001

(54) CRUSHABLE PLASTIC BOTTLE

(76) Inventor: Yoshio Usui, 14-15, Koenji-minami 1-chome, Suginami-ku (JP)

( * ) Notice: Subject to any disclaimer, the term of this patent is extended or adjusted under 35 U.S.C. 154(b) by 0 days.

(21) Appl. No.: 09/142,567

(22) PCT Filed: Dec. 18, 1997

(86) PCT No.: PCT/JP97/04682

§ 371 Date: Sep. 15, 1998

§ 102(e) Date: Sep. 15, 1998

(87) PCT Pub. No.: WO98/31592

PCT Pub. Date: Jul. 23, 1998

(30) Foreign Application Priority Data

Jan. 15, 1997 (JP) ..... 9-036857

(51) Int. Cl.[7] ..... B65D 1/32

(52) U.S. Cl. ..... 220/666; 215/382

(58) Field of Search ..... 215/381, 382, 215/380; 220/666, 667, 907; 138/121, 122, 118, 119; 426/111; 222/92, 107

(56) References Cited

U.S. PATENT DOCUMENTS

| | | | | |
|---|---|---|---|---|
| 972,095 | * | 10/1910 | Booth | 222/92 |
| 2,649,995 | * | 8/1953 | Muskin | 222/92 |
| 2,685,316 | * | 8/1954 | Krasno | 206/524.8 |
| 3,456,850 | * | 7/1969 | Uhlmann | 222/180 |
| 3,926,341 | * | 12/1975 | Lhoest | 215/900 X |
| 5,002,193 | * | 3/1991 | Touzani | 215/100 A |
| 5,054,631 | * | 10/1991 | Robbins, III | 215/900 X |
| 5,174,458 | * | 12/1992 | Segati | 215/383 |
| 5,255,808 | * | 10/1993 | Tobler | 215/900 X |
| 5,397,021 | * | 3/1995 | Usui | 220/667 |
| 5,584,413 | * | 12/1996 | Jung | 220/666 |
| 5,667,101 | * | 9/1997 | Barrash et al. | 222/92 |
| 5,711,445 | * | 1/1998 | Robbins, III | 220/8 |
| 5,746,339 | * | 5/1998 | Petre et al. | 215/383 |
| 5,979,326 | * | 9/1999 | Ohinata | 101/494 |

FOREIGN PATENT DOCUMENTS

| | | |
|---|---|---|
| 586133 | 3/1977 | (CH) . |
| 0611700 | 8/1994 | (EP) . |
| 2288445 | 5/1976 | (FR) . |
| 6812152 | 3/1970 | (NL) . |

* cited by examiner

*Primary Examiner*—Joseph M. Moy
(74) *Attorney, Agent, or Firm*—Laff, Whitesel & Saret, Ltd.; J. Warren Whitesel

(57) ABSTRACT

In a crushable plastic bottle, a plurality of foldable creases are formed on a wall surface of a body of the plastic bottle so as to in a longitudinal direction thereof in parallel. The foldable creases are formed so that wide and narrow creases are arranged alternately so as to form inequilateral lambda's (Λ's). When the foldable creases are folded, the narrow creased are roughly turned over in such a way that each inner surface of the narrow crease is brought into contact with the inner surface of each outward adjacent wide crease. Thus, with each narrow crease sandwiched between the two adjacent wide creases, the wide crease are overlapped with each other and fixed in shape as they are.

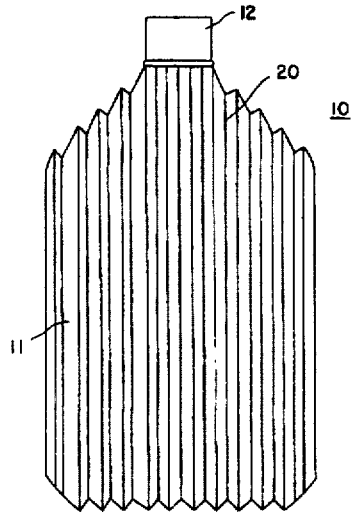

5 Claims, 4 Drawing Sheets